United States Patent [19]

Furstenberg

[11] 4,180,390

[45] Dec. 25, 1979

[54] TEXTILE MACHINE INCLUDING AIR CLEANING APPARATUS

[75] Inventor: Joachim Furstenberg, Aichwald, Fed. Rep. of Germany

[73] Assignee: LTG Lufttechnische GmbH, Stuttgart, Fed. Rep. of Germany

[21] Appl. No.: 904,126

[22] Filed: May 4, 1978

[30] Foreign Application Priority Data

Mar. 23, 1978 [DE] Fed. Rep. of Germany ..... 2812743

[51] Int. Cl.[2] ..... B01D 46/04

[52] U.S. Cl. ..... 55/272; 55/482; 55/341 H; 55/429; 55/385 R; 19/107

[58] Field of Search ..... 55/272, 273, 302, 341 R, 55/341 H, 350, 385 R, 423, 429, 430, 432, 482, 484; 57/56; 19/107

[56] References Cited

U.S. PATENT DOCUMENTS

| | | | |
|---|---|---|---|
| 2,024,469 | 12/1935 | Mitchell | 55/484 |
| 2,375,608 | 5/1945 | Young | 55/429 |
| 2,886,900 | 5/1959 | Flannery | 55/429 |
| 2,914,136 | 11/1959 | Bahnson, Jr. | 55/484 |
| 3,315,446 | 4/1967 | King, Jr. | 55/272 |
| 3,377,783 | 4/1968 | Young | 55/302 |
| 3,486,309 | 12/1969 | Wild | 55/272 |
| 3,486,313 | 12/1969 | Thomas | 55/482 |
| 3,601,955 | 8/1971 | Ferri | 55/350 |

FOREIGN PATENT DOCUMENTS

| | | | |
|---|---|---|---|
| 2542300 | 3/1977 | Fed. Rep. of Germany | 55/296 |
| 1279109 | 11/1961 | France | 57/56 |
| 635894 | 3/1962 | Italy | 55/341 R |

*Primary Examiner*—David L. Lacey
*Attorney, Agent, or Firm*—Edwin E. Greigg

[57] ABSTRACT

The air used in the various operations of a general textile machine is cleaned prior to being returned to the factory space containing the machine by two sequential mechanisms, the first of which is a fiber separator which removes from the air relatively large contaminants such as fibers, pieces of thread, etc., and which transports these remnants to an outlet trap via a rotating conveyor screw. The second mechanism is a dust separator including at least one dust filter bag through which air is forced to pass inwardly, thereby trapping airborne dust on the surfaces of the filter. The accumulated dust on the filter is removed by periodic application of compressed air to the interior of the dust filter bag.

11 Claims, 4 Drawing Figures

TEXTILE MACHINE INCLUDING AIR CLEANING APPARATUS

BACKGROUND OF THE INVENTION

The invention relates generally to textile machinery. More particularly, the invention relates to an apparatus to be used in association with a textile machine for cleaning the air used in the operation of the machine, for example for cooling or for the transport of fibers, etc. The air cleaning apparatus is intended to remove from the air textile remnants, for example fibers, pieces of threads and the like, and is further equipped for the removal of airborne dust and smaller particles. The cleaning apparatus may include mechanical means for collecting and separating the various textile remnants.

The textile machinery which may use the apparatus of the invention can include any commonly used textile machine, for example a carding machine, a ring-spinning machine, an open-end spinning machine, weaving machines, knitting machines, etc.

It is known to equip spinning machines with fiber removal mechanisms through which passes air that is transported by an associated air transport mechanism. The air passes through obliquely positioned sieves which separate textile remnants such as fibers and threads from the air, and these sieves may be cleaned manually from time to time. It is also known in the art to expel the air transported by the air conveyor in a particular spinning machine into the factory space containing a plurality of machines. However, the known fiber removal apparatus is not equipped to retain airborne dust, for example, which thus is expelled into the factory space. It is a further disadvantage of the known apparatus that the filters require periodic manual cleaning and, because such manual cleaning entails difficulties, it is only performed infrequently. Due to this fact, the pressure drop across the filters in the fiber removal unit varies within appreciable limits and thus changes the volumetric air flow rate of the entire air transport mechanism.

OBJECT AND SUMMARY OF THE INVENTION

It is thus a principal object of the present invention to provide a textile machine with an air transport and cleaning apparatus which permits complete cleaning of the air used by the machine prior to its being expelled into the factory space, thereby keeping the fluctuations of the air flow rate within relatively narrow limits without difficulty.

This principal object and other objects to become apparent in the further description of the invention are attained by providing a fiber removal unit and a powered conveyor screw in the same integral housing. The invention further provides a filter at least partially surrounding the conveyor screw with little or no clearance and stationary protrusions for preventing the co-rotation of retained fibers with the conveyor screw, thereby insuring its axial transport along the conveyor screw. A basic fiber removal unit such as is used in the present invention is described by the German Offenlegungsschrift 25 42 300. The textile remnants deposited at the filter of this unit are transported by the conveyor screw to an outlet against which they are pressed, thereby compressing the fibers. When the pressure becomes sufficiently high, a flexible door is opened, whereafter the remnants are collected in a suitable container. The container may be emptied from time to time but automatic means for its voiding may also be provided. Such means could be an automatic conveyor belt or some other transporter.

The known fiber removal unit serves only for filtering out textile remnants from the air. Accordingly, airborne dust will still be present in the air leaving the fiber removal unit because its filter is not able to remove this dust. It is a feature of the present invention that this dust is then removed from the air prior to its expulsion into the factory space or the machine room by a subsequent dust filter.

The two-stage filtering of the air according to the present invention, is carried out in a filter associated with the fiber collector and a dust filter, makes the overall pressure drop across the filters substantially smaller than if the dust were to be filtered out at the same time as the textile remnants.

The air which is thus cleaned in two separate steps no longer contains appreciable quantities of airborne dust and may thus be expelled from the confines of the textile machine back into the machine room or factory space in any desired direction. Usually one air outlet is sufficient but, if necessary, several such outlets may be used for expelling the cleaned air into the machine room. The air which the air transport mechanism aspirates through the air cleaning device may come suitably from the factory space in which the textile machine is located. It is possible however to provide the air at least partially via a line or lines from other locations, for example from an air conditioning unit. Preferably the air which is aspirated by the air transport apparatus of the present invention is previously conditioned or climatized. This will normally be the case if this air is aspirated in the vicinity of the textile machine inasmuch as the air in modern textile machine spaces is already conditioned with respect to temperature and humidity.

The dust filter in the apparatus of the present invention is cleaned automatically by the periodic application of compressed air, which may take place without interruption of the filtering air stream so that the overall pressure drop across the dust filter is kept within narrow limits. The source of compressed air may be disposed at the textile machine or at another location and the volume of compressed air which is used is very small. For this reason, it may be suitable to supply the compressed air to all the machines in a particular factory space, or even several spaces, from one central source via compressed air lines. These compressed air lines need have only small cross sections and their disposition normally entails no difficulty. The control of the flow of compressed air into the textile machine may take place via suitable valves that may be controlled in any desired sequence by associated timing switches. The intervals at which the compressed air is applied to the filtering bags of the dust filter may be, for example, ten minutes, thirty minutes or every hour, etc. However, the compressed air may also be applied under the control of a central mechanism.

The container which collects the accumulated dust may be emptied periodically by hand or may be exchanged for an empty container but it is also possible to remove the accumulated dust continuously or discontinuously by automatic means, for example pneumatically or via a conveyor screw.

The physical integration of the fiber removal mechanism, which automatically cleans its own filter and automatically compresses the textile remnants, with a dust filter that also includes automatic filter cleaning means in the same housing associated with a particular textile machine results in substantial advantages in addition to those already mentioned. Firstly, the air expelled from the textile machine is free of dust and may thus be re-aspirated by the same or other machines without disadvantage either as operating air or cleaning and cooling air. Therefore, in many cases where, previously, the air for cleaning and cooling had to be supplied by a central air preparation unit, for example a central air conditioning unit, via expensive tubulations leading to the particular textile machine, it is possible now, by use of the present invention, to dispense with such lines and to aspirate the required air directly in the vicinity of the textile machine from the ambient air in the factory space.

In heretofore-known installations, if the air within the factory space containing the textile machines was to be dust-free, it was not possible to expel the air used in the operation or the cleaning or cooling of a particular machine directly into the factory space. In order to obtain such dust-free air, the used air had to be transported over expensive and space-consuming air lines out of the factory space and into an appropriate cleaning center. These lines are made unnecessary by the present invention. Still another advantage of the invention is that the fiber removal mechanism and the dust filter need not be very large and can be united in a compact manner.

It is most advantageous if the air transport mechanism is disposed downstream of the dust filter. However, in some cases, it may be suitable to locate the air transport mechanism upstream of the dust filter or even upstream of the fiber removal unit.

Particularly favorable and space-saving disposition results if the conveyor screw of the fiber removal unit has a horizontal axis of rotation while the dust filter unit is disposed above or below the fiber removal mechanism. Such a disposition is usually possible in space-saving manner in association with textile machinery. However, other dispositions are possible within the scope of the invention.

In order to reduce the overall space requirements of the fiber removal unit, it is favorable if the associated fiber filter has an opening in its circumference for admitting the air to be cleaned by this filter. However, in some cases it is possible to provide that the influx of the air to be cleaned takes place at a face end of the filter. In both cases, the air to be cleaned passes through the space defined by screw and thus reaches the filter at an inside surface and passes through it. The remnant removal trap at the end of the fiber collector practically does not permit the passage of air therethrough because its central opening is usually blocked by a mass of compressed textile remnants.

This trap may be preferably embodied so that when the fiber remover does not happen to contain any masses of remnants, the central opening of the trap is closed. In this manner, air does not pass out of the trap nor can air flow into the trap while the filter has not yet collected any textile remnants which, after being transported toward the trap, will force its opening. However, if necessary, the central opening of the trap may be normally open and, prior to use of the machine, it may be deliberately stopped up by hand which prevents air from passing through the central opening until such time as the conveyor screw has itself transported masses of remnants to the trap, thereby preventing the passage of air therethrough.

The remnant trap can have any suitable construction. Preferably it is made from an elastic diaphragm constructed for example of plastic, rubber, or the like. Another preferred embodiment is to make the trap from a plurality of overlapping segments of spring steel, for example, similar in construction to the iris of a photographic camera.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 4:
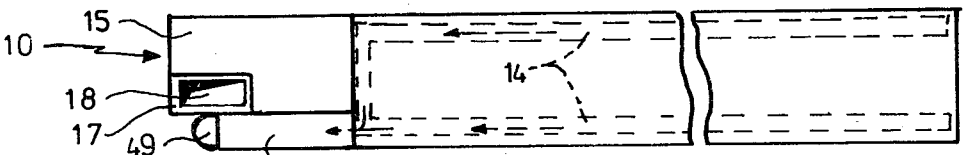
FIG. 4 is a top view of a textile machine in association with the filtering apparatus according to the present invention.

The textile machine with which the cleaning apparatus of the present invention is associated is illustrated schematically in FIG. 4. The overall machine 10 includes a two-stage filtering device 11 consisting of a fiber separator 12 and a directly subsequent dust filtering mechanism 13. The textile machine 10 may be, for example, an open-end spinning machine, a ring spinning machine or any other type of textile machine. In this exemplary embodiment, the machine is shown to have two lengthwise extending air suction lines 14 which are attached to the entrance of the filtering device 11. In the example of a ring spinning machine, these tubes might be thread breakage suction tubes, while in the case of an open-end spinning machine, they might be suction lines which serve to exhaust air from the interior of the spinning rotors or the like. These lines may also be connected to other sources of suction, for example those used for cleaning or cooling. Other suitable lines leading from such sources of suction to the filtering device 11 are entirely suitable. The branch lines to individual places from which air is aspirated may include valves or throttles for adjusting the most advantageous air flow rates.

Disposed at one end of the textile machine 10 is a drive box 15 which includes a drive motor, transmission gears and other elements serving to provide drive power for the textile machine.

In one corner of this enclosure 15, there is located an air suction box 17 containing an air blower 16. The blower 16 may be, for example, an axial fan or may have some other construction. The suction box 17 may also contain other devices, for example mufflers, etc. The outlet 18 of the suction box is located in its top and blows the air cleaned by the filtering device 11 directly into the factory space which contains the textile machine 10.

Figure 1:
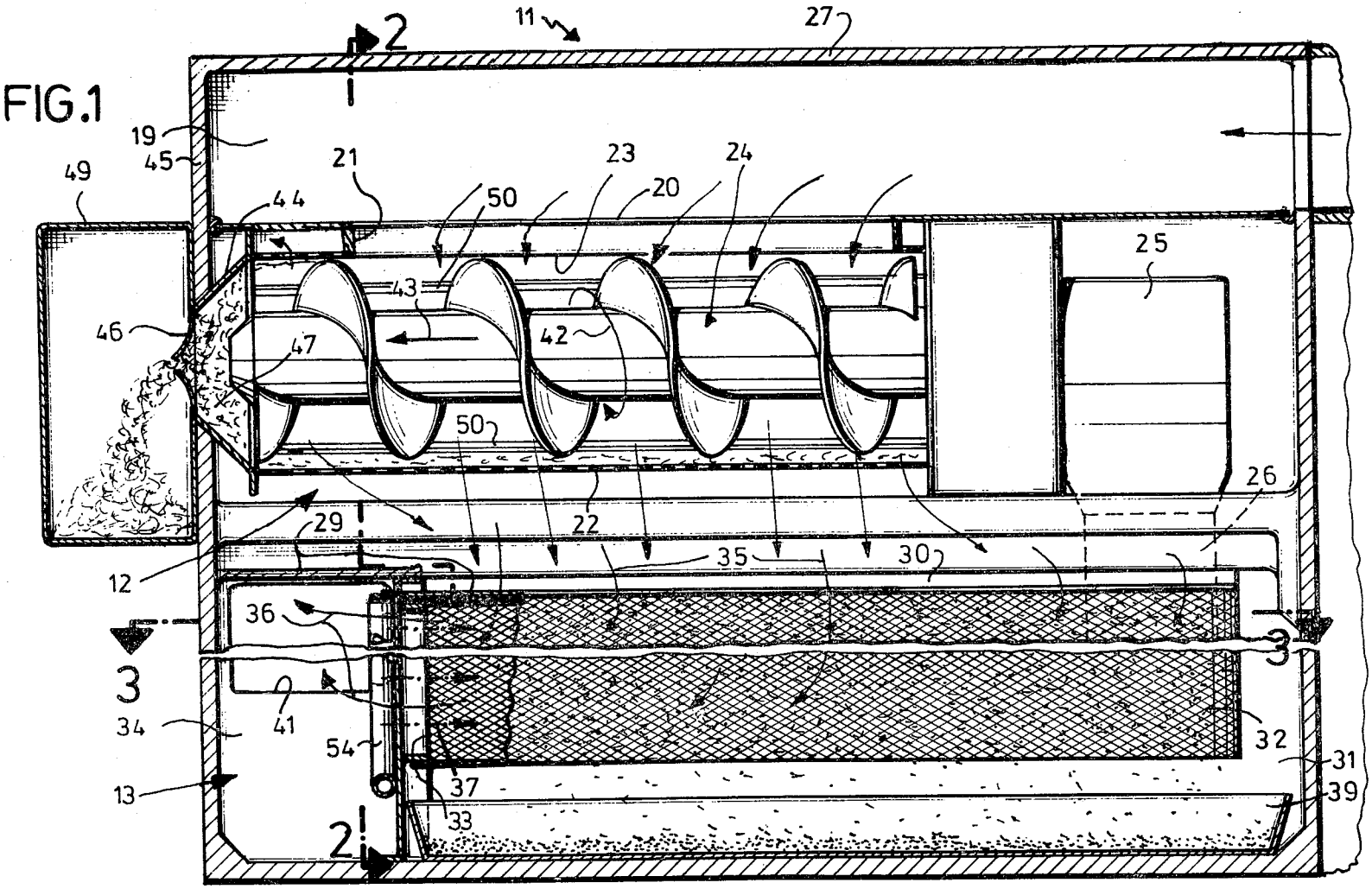
FIG. 1 is a partially sectional illustration of a front elevational view of the two-stage filtering apparatus of the invention which is an integral part of a textile machine shown partly in FIG. 4. It is obtained from a section along the line 1—1 in FIG. 2 with the lower portion shown partly broken away to permit a view of the interior of the filter.
Figure 2:
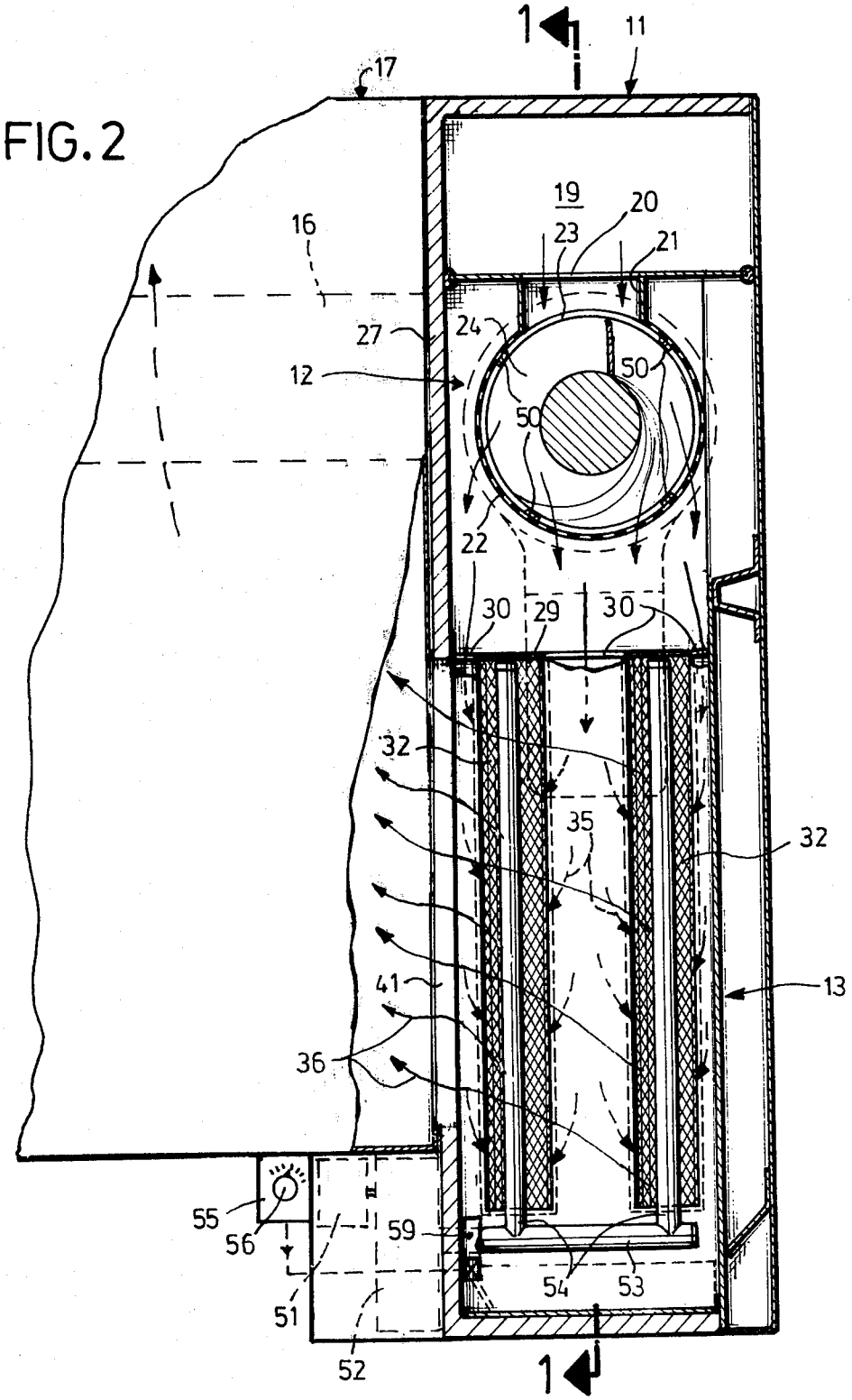
FIG. 2 is a section through the filtering system of FIG. 1 viewed along the line 2—2 wherein the box containing the air transport ventilator is shown only partially and partly broken away.
Figure 3:
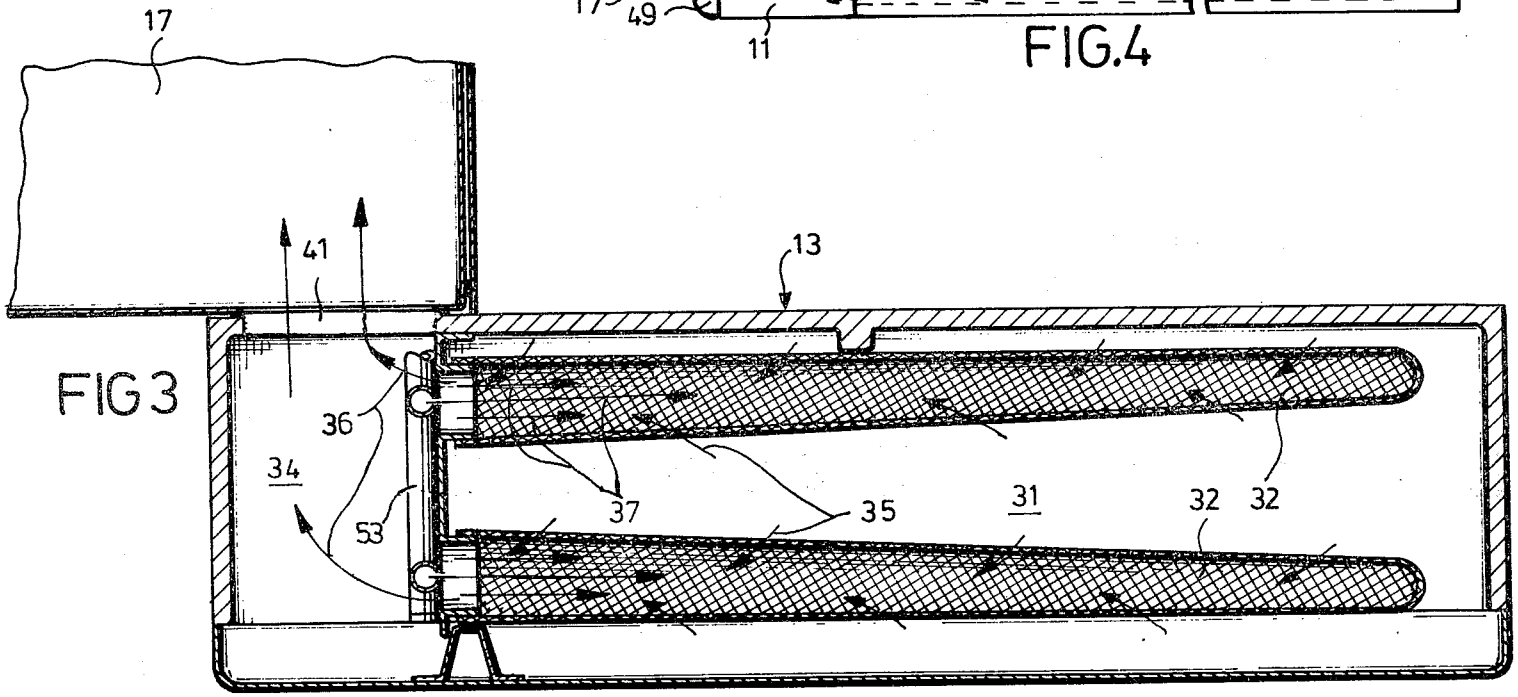
FIG. 3 is a section through FIG. 1 along the line 3—3.

The filtering device 11 whose external appearance is also box-like and which is directly connected to the suction box 17 is described in detail in FIGS. 1–3. This filtering device 11 has an upper horizontal channel 19 of substantially rectangular cross section into which the contaminated air is admitted. The aforementioned suction lines 14 are connected to the inlet of the channel 19. The channel 19 extends over the longitudinal direction of the machine 10. The horizontal bottom of the channel 19 has an elongated rectangular air passage 20 leading to a short tubular stub 21 which is connected to a filter 22 in the shape of a circular cylinder and constructed from a metal mesh or some other filtering material. The inlet 23 to the filter 22 is connected to the tubular stub 21. The incoming air thus flows from the channel 19 through the passage 21 and the opening 23 into the interior of the filter 22 substantially perpendicular to its long axis. At this point, the air which is present within the filter 22 is still not cleaned. Disposed coaxially with and inside of the filter 22 is a conveyor screw 24, the blades of which extend to within a few millimeters of the inside surface of the filter 22. The conveyor screw 24 is rotated by gears 25 powered by an electric motor 26 at some constant speed and may rotate continuously at constant speed during the operation of the textile machine. In some cases, it may be suitable to drive the conveyor screw 24 only intermittently. The construction of the filter 22 is such that it is able to remove from the air, which flows through it from the inside to the outside, any textile remnants, such as fibers, thread ends, textile fragments, knots, etc., without however removing substantial amounts of airborne dust. The dust still carried by the air which has passed through the filter is subject to removal by a dust filter mechanism 13 which is disposed downstream of the fiber separator 12.

The dust filter 13 is located beneath the fiber separator 12 in the same rectangular housing 27. The top of the dust filtering mechanism 13 has, for example, three long slots 30 which communicate with the entry chamber 31 of the dust filtering mechanism 13. This chamber 31, to which is admitted air still containing dust particles, contains two suspended, elongated, relatively narrow filtering bags 32 which include internal reinforcements that prevent their collapse under pneumatic pressure. The filter bags 32 have vertical air outlets 33 which are disposed perpendicular to the long axis of the machine and the rotational axis of the conveyor screw 24 and which terminate in a clean chamber 34 which admits dust-free air. The filter bags 32 are attached to rails which are part of the top 29 of the filtering mechanism. The air to be filtered flows in the direction of the arrows 35 into the filtering bags 32 through their outside surface, as best seen in FIG. 3, and continues in the direction of the arrows 35 while being filtered within the bags 32. The clean dust-free air then leaves the bags in the direction of the arrows 36 and enters the clean chamber 34. The filtering device also includes means for intermittent admission of compressed air to the interior of the filtering bags to remove dust collected at their outside surfaces and the flow of this compressed cleaning air is shown in FIG. 3 for example, by the arrows 37. It is provided in a manner to be described further below. A cross section through the filtering bags shows them to be substantially narrow and rectangular, as best seen in FIG. 3, and they become somewhat wider toward the outlets 33 for the purposes of compensating for the changing internal volume of flow.

Placed below the two filtering bags on the bottom of the chamber 31 is a container 39 for receiving any dust or dust balls, or the like, which are dislodged from the outside of the filtering bags 32 by the compressed air jets in the direction of the arrows 37. These dust accumulations will fall into the container 39 even if they are removed while the primary air flow through the filtering device 11 which serves for cleaning the air is not interrupted, i.e. even if the fan 16 continues to aspirate air through the filtering system 11. The container 39 may be removed through an opening, not shown, and be emptied or exchanged for another container.

The clean chamber 34 of the dust filter mechanism 13 connects via an opening 41 with the suction chamber 17. Disposed at the end of the conveyor screw toward which trapped fiber remnants are transported is a conical extension 44 which terminates in an opening in the vertical wall 45. This opening may be covered by an elastic, diaphragm-like trap 46 having a central hole and which may be made, for example, of rubber or plastic. It may also be constructed in some other way, for example in the manner of an iris with a plurality of overlapping elastic segments which are deformed by the pressure of the transported remains 47 through a central opening of the trap 46. Normally, the central opening of the trap 46 is closed to the passage of air due to the presence in it of compressed remnants 47. Additional amounts of compressed remnants 47 which are transported by the conveyor screw 24 continue to be forced through the opening and then drop into a container 49 which may be cleaned out from time to time. The place of the container 49 may be taken by a bag or the like.

The filtering device 11 illustrated and described above operates as follows.

During the operation of the textile machine 10, the air fan 16 continuously aspirates air through the lines 14 from the filtering device 11 and continuously expels it from the textile machine via the air outlet 18 into the factory space in which the textile machine is located. The air which is aspirated in the present preferred embodiment is air previously contained in the factory space, i.e. air surrounding the textile machine 10 which is pulled into its suction orifices by the fan 16. This air flows out of the lines 14 into the uncleaned air chamber 19 of the fiber separator 12 and through the tubulation 21, past the conveyor screw 24. The air then passes through the surrounding filter 22 where textile remnants, fiber ends, etc., are retained at the inside. This precleaned air which contains only fine suspensions, dust, etc., now enters the dust filtering mechanism 13 where it is cleaned of any fine dust suspensions, whereafter it passes through the suction box 17 and out of the outlet 18. The various textile remnants which are removed from the air by the filter 22 of the fiber separator are continuously transported by the conveyor screw 24 to the trap 46 and are expelled through its central opening into the container 49. Due to the relatively small central opening of the trap 46, the textile remnants accumulate in the conveyor screw and bend the trap 46 outwardly to varying degrees. Thus, the cooperation of the screw 24 and the trap 46 compresses the remnants considerably and they are dropped in this compressed state from the central opening in the trap 46 into the container 49 where they retain their state of compression for further transport. The compressed remnants may be removed from the container 49 by hand or in some other suitable way.

In order to prevent the textile remnants removed by the filter 22 from rotating with the conveyor screw 24 which would prevent their being transported axially, there are disposed in the present exemplary embodiment anti-rotation rods 50 which are located at the interior surface of the filter 22 and are separated from one another by distances which correspond to 90 angular degrees of rotation. These rods have rectangular cross section and are disposed parallel to the rotational axis of the conveyor screw 24 and serve as a stationary stop for matter being carried by the conveyor screw. There are four such rods 50 located between the periphery of the conveyor screw 24 and the filter 22; their thickness is slightly less than the very small distance between the conveyor screw 24 and the filter 22.

The rods 50 reliably prevent the rotation of the retained remnants with the conveyor screw 24 which are thus axially transported to the trap 46 and through its central opening.

The retained fibers, etc., within the filter 22 tend to adhere to one another and as a result, the conveyor screw 24 carries all of them along axially toward the trap 46 and thus tends to clean the interior surface of the filter 22 at all times, thereby keeping the pressure drop across the filter 22 relatively low.

Other suitable arrest elements may be used in place of the rods 50, for example those illustrated by the German Offenlegungsschrift 25 42 300.

The fiber separator 12 described above has a very compact construction and requires very little space so that it may be installed in a textile machine without difficulty.

The periodic cleaning of the filter bags 32 of the dust filtering mechanism 13 takes place by means of intermittent jets of compressed air which are introduced into the bags 32 along the arrows 37. These air jets are supplied in the present exemplary embodiment by a compressor 51 which charges a compressed air tank 52 up to a predetermined pressure and then shuts itself off automatically in known fashion. The compressed air container is connected via lines 53, 54 and a solenoid valve 59, the line 53 being a longitudinal line while the lines 54 are two vertical lines leading to the centers of the openings 33 in the bags 32. They have suitable nozzles which direct the air to the interior of the filtering bags 32.

An electrical timer 55 can be adjusted by a knob 56 to generate periodic electrical pulses to operate the solenoid valve 59. The effect of the compressed air jets is to dislodge the layers of dust which have accumulated on the exterior surfaces of the filtering bags 32 and to separate them into clumps which fall into the container 39. It should be noted that the flow of cleaning air generated by the conveyor fan 16 may be maintained during the cleaning operation of the filters and thus air continues to be aspirated through the filtering system 11 during the admission of compressed air jets.

The foregoing relates to a preferred exemplary embodiment of the invention, it being understood that other embodiments and variants thereof are possible within the spirit and scope of the invention.

What is claimed and desired to be secured by Letters Patent of the United States is:

1. A textile machine having a textile processing unit in combination with air transport and cleaning means for aspirating air from a source of air for use by said textile processing unit and for thereafter cleaning said air of textile and fiber remnants as well as of airborne dust particles, said air transport and cleaning means including:

a housing, a fiber separator including a rotatable conveyor screw rotatably supported in said housing, a filter at least partially surrounding said conveyor screw in closely spaced relationship therewith, said fiber separator being provided with stationary means for preventing co-rotation of the filtered remnants in said fiber separator with said conveyor screw, said air transport means being arranged to supply said fiber separator with dirty air containing fibers and dust, said dirty air passing across said conveyor screw and through said filter so that trapped fiber remnants are conveyed axially by said conveyor screw toward one end thereof, said fiber separator further including a flexible trap at one end of said conveyor screw, said flexible trap having a central opening which may be enlarged by the pressure of accumulating fiber remnants being transported by said conveyor screw thereby permitting said remnants to be expelled therethrough; and a dust separator in said housing, means in said housing for directing air from said fiber separator into said dust separator after passage through said filter, said dust separator including at least one dust filter bag for removing dust from the air, said dust separator further including means for applying periodic bursts of compressed air to said at least one dust filter bag to dislodge accumulated dust therefrom.

2. A textile machine as defined by claim 1, wherein said air transport means includes suction means for drawing air from the interior of said at least one dust filter bag, whereby dust-laden air passes through the surface of said at least one dust filter bag to the interior thereof to be cleaned thereby and wherein said means for applying periodic bursts of compressed air applies the burst to the interior of said at least one dust filter bag to dislodge accumulated dust therefrom.

3. A textile machine as defined by claim 1, further comprising control means connected to said means for applying said periodic bursts of compressed air whereby said bursts are applied to the interior of said at least one dust filter bag in variable and predetermined time periods.

4. A textile machine as defined by claim 1, wherein said means for applying periodic bursts and said air transport means are separate and independent and wherein said means for applying said periodic bursts applies said periodic bursts of compressed air to said at least one dust filter bag without interrupting the continuous operation of said fiber separator and said dust separator.

5. A textile machine as defined by claim 1, wherein said air transport means is disposed downstream of said dust separator.

6. A textile machine as defined by claim 1, wherein said air transport means includes a fan.

7. A textile machine as defined by claim 1, including a floor on which said textile machine is located and wherein said conveyor screw in said fiber separator is disposed with a horizontal axis of rotation with respect to said floor on which said textile machine is located.

8. A textile machine as defined by claim 1, wherein said fiber separator is disposed in said housing above said dust separator.

9. A textile machine as defined by claim 7, wherein said at least one dust filter bag has an orifice through which clean air passes out of said at least one dust filter bag and wherein the plane of said orifice is vertical with respect to the floor on which said textile machine is mounted.

10. A textile machine as defined by claim 1, wherein said filter in said fiber separator substantially surrounds said conveyor screw except for an opening through which passes the air to be cleaned.

11. A textile machine as defined by claim 1, wherein said at least one dust filter bag is provided with an outlet opening and wherein the plane of said outlet opening of said at least one dust filter bag is approximately perpendicular to the axis of rotation of the conveyor screw of said fiber separator.

* * * * *